US005280698A

United States Patent [19]

Gerstner-Stevens et al.

[11] Patent Number: 5,280,698

[45] Date of Patent: Jan. 25, 1994

[54] THREAD SPLICING ARRANGEMENT

[75] Inventors: Ditmar Gerstner-Stevens, Obertshausen; Adalbert Balbach, Hainburg, both of Fed. Rep. of Germany

[73] Assignee: Karl Mayer Textilmaschinenfabrik GmbH, Obertshausen, Fed. Rep. of Germany

[21] Appl. No.: 771,722

[22] Filed: Oct. 4, 1991

[30] Foreign Application Priority Data

Oct. 12, 1990 [DE] Fed. Rep. of Germany ..... 4032512

[51] Int. Cl.[5] ..... D01H 15/00

[52] U.S. Cl. ..... 57/22

[58] Field of Search ..... 57/22, 23, 333, 350, 57/202

[56] References Cited

U.S. PATENT DOCUMENTS 4,433,534 2/1984 Mima ..... 57/22
4,630,433 12/1986 Premi ..... 57/22
4,693,067 9/1987 Locatelli ..... 57/22
4,938,013 7/1990 Zumfeld ..... 57/22
5,152,131 10/1992 Locatelli ..... 57/22

*Primary Examiner*—Joseph J. Hail, III
*Attorney, Agent, or Firm*—Omri M. Behr; Matthew J. McDonald

[57] ABSTRACT

There is provided a thread splicing arrangement having a splicing head with a splicing channel. In the vicinity of the ends of the channel, holding devices can clamp the ends of the threads during the splicing, and cutting arrangements can cut the free ends of the threads. The holding devices hold the threads near the base of the splicing channel. Pressurized gas channels are provided on both sides of the middle of the splicing channel. The outlets of these gas channels are located in the channel base and extend on both sides of a longitudinal plane of symmetry of the splicing channel. The axes of the pressurized gas channels approach that plane of symmetry at equal but opposite angles. This leads to a simple mode of construction providing good splicing for various different thread materials.

12 Claims, 2 Drawing Sheets

THREAD SPLICING ARRANGEMENT

BACKGROUND OF THE INVENTION

The invention is directed to a thread splicing arrangement having a splicing head with a splicing channel which is open at both ends and on one side thereof, for the receipt of thread to be spliced. Discharging into such a splicing channel are two pressurized gas channels whose outlets are arranged symmetrically with respect to the middle of the splicing channel. Such a thread splicing arrangement has a lid for closing the open side of the splicing channel as well as a holding means outside the splicing channel and close to the open ends thereof, for clamping the two thread ends being spliced together with a cutting arrangement for cutting the free thread ends.

In a known thread splicing arrangement of this type (DE PS 3536580), a pressure gas channel discharges in the center of the base of a splicing channel and has an axis perpendicular to the longitudinal axis of the channel. A holding means is so provided that after the splicing of the threads in the splicing chamber, they are located near the lid thereof. During the splicing step the pressurized gas stream forces the threads against the lid and then divides itself into two partial streams which discharge from both ends of the channel thereby entangling the threads with each other. Instead of just a single central gas outlet opening in the middle of the splicing channel base, two or more openings may be provided symmetrically with respect to the center of the splicing channel. Since during splicing a free, that is, unclamped thread end is permitted, a very simple mode of construction is possible. For example, the cutting step can be simultaneous with the closing of the lid.

In another known type of thread splicing arrangement (DE PS 3040661) a pair of pressurized gas outlets are located above and below the transverse symmetrical plane of the splicing channel as well as to the left and the right of a longitudinal symmetrical plane. Accordingly, one gas stream creates a clockwise air vortex and the other a counter-clockwise air vortex about the inserted threads, thereby effectively splicing tightly twisted yarns and threads. In practice, the ends of both of the inlaid threads are held fast close to the outer ends of the splicing channel. The gas streams running alongside the threads generally take hold of the circumference of the threads.

One air stream for splicing by a further known thread splicing arrangement (DE OS 33 37 847) comprises a vortex chamber in which the inlaid yarn ends are cut and held and are spliced by at least a further air stream. For this purpose there are provided one or more splicing jets transverse to the axis, in the middle area of the vortex chamber; whereas in the area of the front end of the vortex chamber, there is provided at least one preparation jet. This preparation jet can operate either with over-pressurized gas or with a vacuum. The air stream can be given a counter-twisting movement to assist the unspinning of the thread.

In another known thread splicing arrangement (DE OS 38 08 814), there are provided a pair of mutually opposed, slot-shaped air jets whose streams meet just above the thread lying on the base of the splicing chamber. Outside the vortex chamber there are provided two reverse twist jets for thread end preparation. Between these and the vortex chamber there is provided a thread pressing arrangement which holds the threads at both ends.

An object of the present invention is to provide a thread splicing arrangement of the generally described foregoing type which despite the presence of free threads ends achieves a good splicing result for a variety of different thread materials.

SUMMARY OF THE PRESENT INVENTION

In accordance with the illustrative embodiments demonstrating features and advantages of the present invention, there is provided a thread splicing arrangement comprising a splicing head having a splicing channel. The splicing channel is open at both ends and at one open side thereof for the receipt of threads to be bound together. The splicing channel contains a base opposite said open side. The thread splicing arrangement also has two pressurizable gas channels for injecting gas into the splicing channel. These gas channels have two gas outlets equidistantly spaced from the center of the splicing channel. These gas outlets are located at the base of the splicing channel and extend onto both sides of a longitudinal plane intersecting the splicing channel. The two gas channels have two delivery axes angled to approach the longitudinal plane from opposite sides thereof. The thread splicing arrangement also has a lid, a holding means and a cutting arrangement. The lid can close the open side of the splicing channel. The holding means is external and proximate to the two ends of the splicing channel and can hold the ends of the threads during splicing. The cutting arrangement can cut the free ends of the threads during splicing.

By employing apparatus of the foregoing type an improved thread splicing arrangement is achieved. Preferably the outlet openings are located in the channel base on both sides of the longitudinal plane running symmetrically through the splicing channel with the axes of the pressurized gas channels angled into opposite sides of this longitudinal symmetry plane.

In this mode of construction at the beginning of the splicing step, a substantial proportion of the threads lie in the jet from the pressurized gas channels. They thus receive an initial impact which leads to a loosening of the threads, a displacement in the direction of the lid and similarly an inward pulling of the free thread ends. Consequently, the threads occupy a larger proportion of the splicing channel cross-section. The gas streams running at an angle to the longitudinal symmetrical plane thus also impact on the thread material so that the entangling effect occurs at the same time as the rotational influence on the threads. Thus, the free thread end can follow the rotation and thus, for better entanglement, loosen its own twist.

There is a further advantage in that the holding means hold the threads close to the channel base. Since the threads lie close to the outlets of the pressurized gas channels, there is achieved a particularly strong loosening effect.

It has been found particularly effective to make angle of axis of the pressurized gas channel to the longitudinal plane of symmetry between 20° to 40°, 30° being particularly preferred. At these values, the gas streams do not enter tangentially but rather have a motion component in the tangential direction. Thus, the direct impact upon the threads is supported both at the beginning and during the splicing interval without neglecting the influence of a twisting motion.

It is further advantageous that the outlets extend in the circumferential direction of the cylindrical splicing channel for an amount that is at least 30% of the channel diameter. This value further ensures that at the beginning and during the splicing there is generally a direct impact upon the threads.

It is also advantageous that the splicing head be formed of two mutually joined parts; namely an upper portion which contains the splicing channel and the two slanted, pressurized gas channels, and a lower plug portion which has a pressurized gas channel of so large a cross-section that it embraces the inlets of the two pressurized gas channels. This two-part construction simplifies the manufacture of the splicing head.

DESCRIPTION OF THE DRAWINGS

The invention is illustrated in the accompanying drawings, illustrating the preferred embodiments, wherein.

DETAILED DESCRIPTION OF THE PREFERRED EMBODIMENTS

Figure 1:
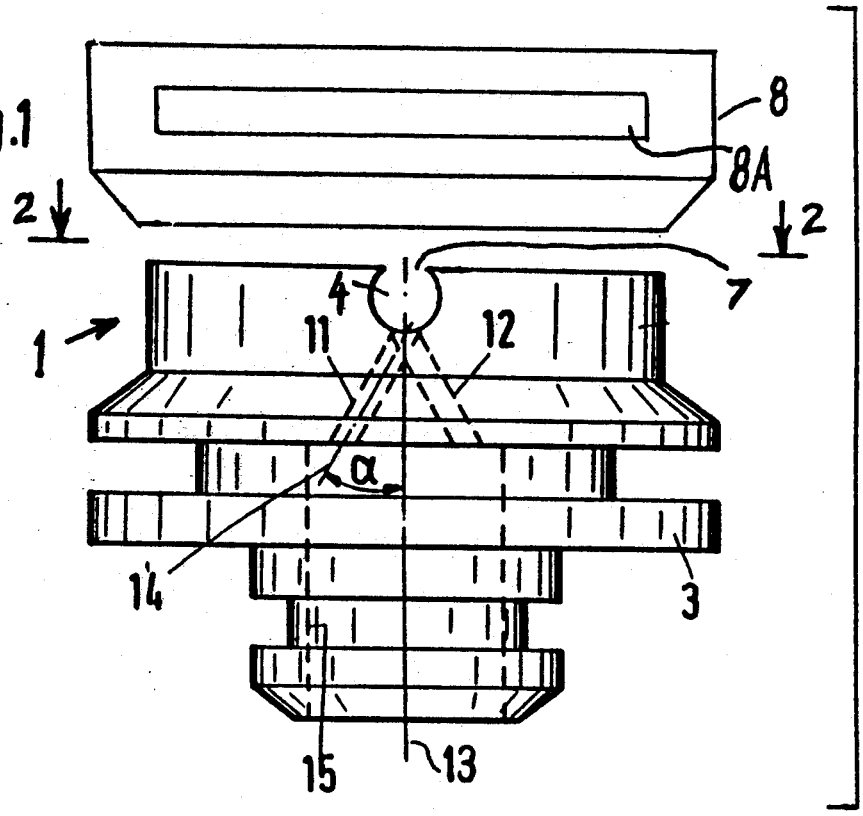
FIG. 1 is an elevational view of a thread splicing arrangement according to the principles of the present invention, and employing a lid shown separated from a splicing head.
Figure 2:
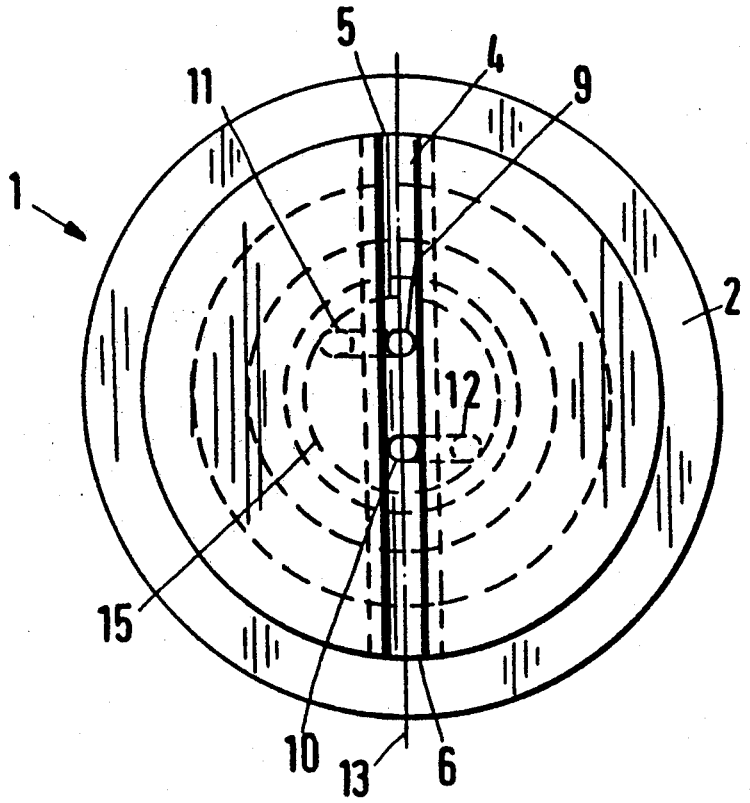
FIG. 2 shows a plan view of the splicing head of FIG. 1, taken along line 2—2 of FIG. 1.
Figure 3:
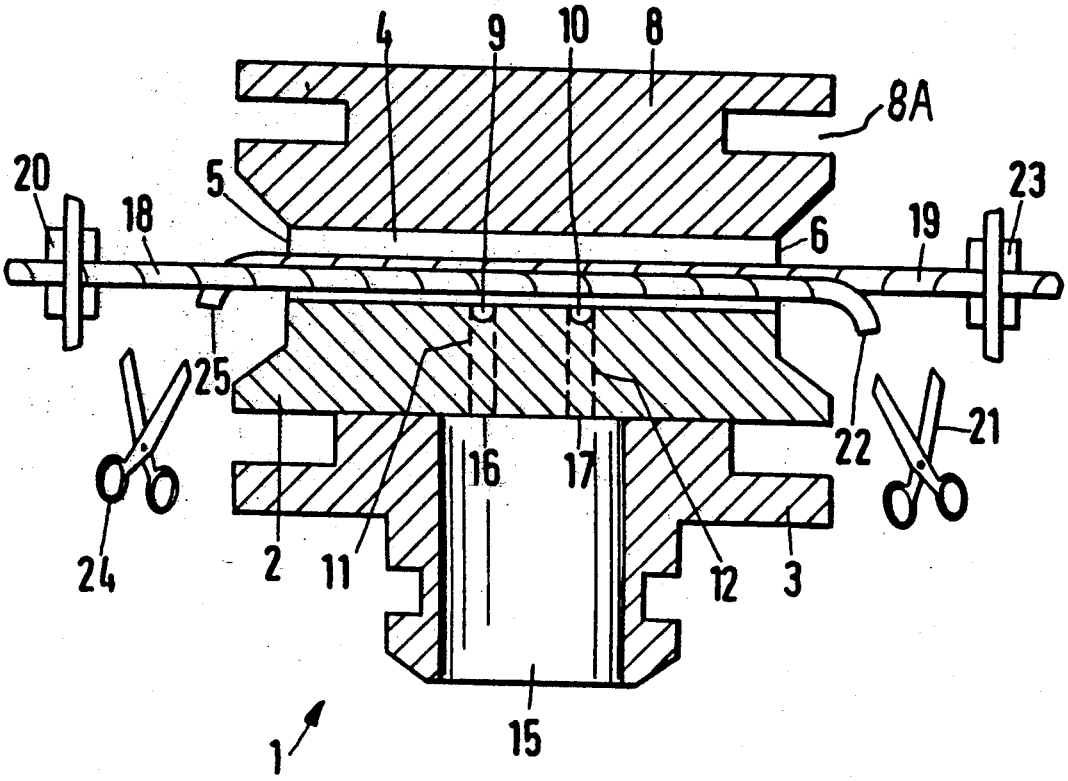
FIG. 3 is an elevational view of the thread splicing arrangement of FIG. 1 with the lid closed on the splicing head and the latter shown in section along plane 13 of FIG. 1.

Referring to FIGS. 1, 2 and 3, a splicing head 1 comprises an upper segment 2 and a lower plug segment 3 which may be connected to each other by soldering, welding, or any other suitable means. The outer surfaces of segments 2 and 3 are for the most part cylindrical or frustro-conical and are generally solids of revolution. The upper segment 2 comprises at its top surface, a diametrically disposed splicing channel 4 having a circular cross-section. It is open at ends 5 and 6 and has an upwardly directed opening 7. This opening 7 is closed by lid 8 during the splicing process.

Lid is a conventional closure (see e.g., closure 31 of previously mentioned DE PS 35 36 580). Lid 8 may be held onto the top of the splicing chamber 4 by means of a pneumatically controlled chamber (not shown). Side grooves 8A facilitate the operation of cutting means 21 and 24 (FIG. 3).

On both sides of the middle of the splicing channel, there are provided outlets 9 and 10 of two pressurized gas channels 11 and 12, respectively. The outlets 9 and 10 are located on each side of the longitudinal plane of symmetry 13 of the splicing channel 4. The axis 14 of pressurized gas channel 11 subtends an angle (alpha) of 30° to said plane 13. The axis of the other gas pressurized channel 12 subtends a mirror image angle.

The lower plug segment 3 comprises an annular, pressurized gas feed channel 15 having a bore with a cross-section large enough to encompass the inlets 16 and 17 at the upstream ends of pressurized gas channels 11 and 12. This lower plug is inserted, in the usual way, into a socket (not shown) supplied with a regulated, pressurized air or other gas.

FIG. 3 shows two threads 18 and 19 laid into the splicing channel 4. The thread 18 is held proximal to one end 5 of the splicing channel 4 by holding means 20, while a schematically illustrated cutting arrangement 21 cuts the free end 22 of this thread. In a similar manner, thread 19 is held near end 6 of the splicing channel 4 and held there by clamping means 23, while a cutting arrangement 24 similarly schematically illustrated cutting free end 25. The holding means 20 and 23 are so provided that they hold adjacent segments of threads 18 and 19 in the vicinity of the channel base, which means that this orientation also substantially applies in the vicinity of the outlets 9 and 10.

When pressurized gas is applied through pressurized gas feed channel 15 for a predetermined time, two gas streams are projected by the jets from the openings 9 and 10, which impinge upon the adjacent threads, loosening these up and pressing them against the lid 8, as well as pulling the free ends 22 and 25 somewhat inwardly. Since the pressurized gas streams are located at an angle, not only is there provided a directed impact but because of the shape of the splicing channel, there is also provided a turning moment to the threads. These together, lead to an extraordinarily satisfactory mutual binding of the threads.

In one particular embodiment, where the diameter of the splicing channel 4 is 4 mm, the pressurized gas channels 11 and 12 may suitably have a diameter of between 1.2 through 1.5 mm. The long dimension of the mouth of channels 11 and 12 opening into the splicing channel 4 (measured in the circumferential direction of the splicing channel 4) is between 1.4 and 1.75 mm or approximately 35 to 43% of the diameter of splicing channel 4.

Different embodiments of the same invention that are alternates to the illustrated examples may be modified in several ways. For example, the center of the splicing channel can have a further pressurized gas inlet which flows perpendicularly to the splicing channel axis. The pressurized gas channels 11 and 12 can also be relocated outwardly in the direction of ends 5 and 6 of the splicing channel.

We claim:

1. A thread splicing arrangement comprising:

a splicing head having a splicing channel open at both ends and on one open side thereof for the receipt of threads to be bound together, said splicing channel having a longitudinal axis, said splicing channel having internally a base opposite said open side;

two pressurizable gas channels for injecting gas into said splicing channel, said gas channels having two gas outlets equidistantly spaced from the center of said splicing channel, said gas outlets being located at the base of the splicing channel and each extending onto both sides of a longitudinal plane intersecting the longitudinal axis of said splicing channel, said two gas channels having two delivery axes angles to approach said longitudinal plane from opposite sides thereof;

a lid for closing the open side of said splicing channel;

holding means external and proximate to the two ends of said splicing channel for holding the ends of the threads during splicing; and a cutting arrangement for cutting the free ends of said threads during splicing.

2. A splicing arrangement according to claim 1 wherein the holding means comprises two holding arrangements proximate to the base of the splicing channel.

3. A splicing arrangement according to claim 2 wherein the each of the delivery axes of the gas channels intersects the longitudinal plane at an injection angle of 20° to 40°.

4. A splicing arrangement according to claim 3 wherein the injection angle is approximately 30°.

5. A splicing arrangement according to claim 2 wherein the mouth width of each of the gas outlets is at least 30% of the diameter of the splicing channel, said overall mouth width being measured along a plane transverse to said longitudinal plane.

6. A splicing arrangement in accordance with claim 2 wherein the splicing head comprises:

a head portion comprising the splicing channel and the two angled gas channels; and a lower plug means rigidly attached to said head portion and having a gas feed channel with a diameter sufficiently large to encompass the upstream ends of said gas channels.

7. A splicing arrangement according to claim 1 wherein the each of the delivery axes of the gas channels intersects the longitudinal plane at an angle of 20° to 40°.

8. A splicing arrangement according to claim 7 wherein the mouth width of each of the gas outlets is at least 30% of the diameter of the splicing channel, said overall mouth width being measured along a plane transverse to said longitudinal plane.

9. A splicing arrangement in accordance with claim 7 wherein the splicing head comprises:

a head portion comprising the splicing channel and the two angled gas channels; and a lower plug means rigidly attached to said head portion and having a gas feed channel with a diameter sufficiently large to encompass the upstream ends of said gas channels.

10. A splicing arrangement according to claim 1 wherein the mouth width of each of the gas outlets is at least 30% of the diameter of the splicing channel, said overall mouth width being measured along a plane transverse to said longitudinal plane.

11. A splicing arrangement in accordance with claim 10 wherein the splicing head comprises:

a head portion comprising the splicing channel and the two angled gas channels; and a lower plug means rigidly attached to said head portion and having a gas feed channel with a diameter sufficiently large to encompass the upstream ends of said gas channels.

12. A splicing arrangement in accordance with claim 1 wherein the splicing head comprises:

a head portion comprising the splicing channel and the two angled gas channels; and a lower plug means rigidly attached to said head portion and having a gas feed channel with a diameter sufficiently large to encompass the upstream ends of said gas channels.

* * * * *